United States Patent [19]

Takei

[11] 4,378,923

[45] Apr. 5, 1983

[54] BINDING DEVICE FOR ELONGATED PIPES

[75] Inventor: Isao Takei, Yokohama, Japan

[73] Assignees: Nippon Kokan Kabushiki Kaisha, Chiyoda; Nichiei Distribution Systems, Inc., Kawasaki, both of Japan

[21] Appl. No.: 281,569

[22] Filed: Jul. 9, 1981

[51] Int. Cl.[3] ..... F16L 3/22

[52] U.S. Cl. ..... 248/68 R; 108/51.3; 248/68 CB; 206/443

[58] Field of Search ..... 248/68 R, 68 CB, 73, 248/74 B; 206/443; 410/32, 36, 37; 211/495; 108/901, 51.3, 3; 206/585, 593

[56] References Cited

U.S. PATENT DOCUMENTS

| | | | |
|---|---|---|---|
| 1,835,632 | 12/1931 | Buhrke | 24/248 B |
| 2,059,390 | 11/1936 | Pagel | 206/443 X |
| 3,682,422 | 8/1972 | Evans | 248/68 CB |
| 4,030,540 | 6/1977 | Roma | 248/68 CB X |
| 4,036,289 | 7/1977 | Cheng et al. | 248/68 CB X |
| 4,098,326 | 7/1978 | Waters | 248/68 R X |
| 4,167,211 | 9/1979 | Haller | 248/68 CB X |

*Primary Examiner*—James T. McCall
*Assistant Examiner*—Ramón O. Ramírez
*Attorney, Agent, or Firm*—Darby & Darby

[57] ABSTRACT

A binding device for a plurality of elongated pipes is provided which comprises a pair of pipe reception blocks, sleepers interposing the blocks therebetween, and a bundling strap encircling tightly a pair of pipe reception blocks, and the sleepers. The pipe reception block includes two regions, one being the region where concavities are formed and the other being the region where the surface contacting with the sleeper is formed. The former may preferably be made of rigid polyurethane resin, and the latter of a veneer plywood.

6 Claims, 6 Drawing Figures

BINDING DEVICE FOR ELONGATED PIPES

BACKGROUND OF THE INVENTION

1. Field of the Invention

This invention relates to a binding device for shipping and the storage of a plurality of elongated pipes.

2. Prior Art

In those known cases in the prior art, a plurality of elongated pipes have been accumulated in a bundle and then tightly secured together with a steel wire or the like. This binding method has been widely adopted in the fields of transportation due to its relatively simple process. While on the other hand, there are some disadvantages that the elongated pipes are subjected to possible damages destroying protective coatings by direct contacting with the steel wire or the like. Moreover, since the bundle formed of a plurality of elongated pipes is encircled and tightened by a steel wire which contacts only with some localized or restricted surface portions of each of the outermost disposed elongated pipes, those pipes within the bundle may shift and the bundle is liable to crush or deformation during transportation or storage in a stacked condition, thus lacking a stable, safe and quick handling of the elongated pipes. Furthermore, in this conventional method, no countermeasures are provided for protecting each of the elongated pipes against bends or dents.

SUMMARY OF THE INVENTION

It is therefore an object of this invention to provide a binding device for a plurality of elongated pipes in which the above disadvantages are fully eliminated.

According to this invention the binding device for a plurality of elongated pipes comprises a pair of pipe reception blocks, first and second sleepers interposing the blocks therebetween, and a bundling strap encircling a pair of the pipe reception blocks, and the first and second sleepers. A plurality of elongated pipes are disposed side by side or in transverse arrangement with respect to the longitudinal axes of the pipes each within a space defined by the concavities formed on one surface of the blocks. The curvature of the concavities is substantially equal to the external curvature of the elongated pipes. One of a pair of the pipe reception blocks rests on the first sleeper, and the second sleeper is placed on the other of a pair of the pipe reception blocks. This assembly is completed and integrated by a tightly encircled bundling strap means along the traverse surface of the assembly. This assembly may be stacked in overlying arrangement with one or more of other similar assemblies.

The pipe reception block may be made of two regions of different material, one being the region where the concavities are formed and the other being the region where the surface contacting with the sleeper is formed. The former region is preferably made of rigid polyurethane resin, and the latter is preferably made of a veneer plywood. The different materials are fixed together with an appropriate adhesive agent. The pipe reception block thus constructed has sufficient mechanical strength to bear against deformation so that it protects the elongated pipes from deformation and also enables to decrease the height of the sleepers which might have otherwise been of a considerable volume so as to withstand the external forces imparted during handling or transportation.

The foregoing and other objects, features and advantages of the invention will be apparent from the following, more detailed, description of preferred embodiments taken in conjunction with the accompanying drawings.

DESCRIPTION OF THE PREFERRED EMBODIMENTS

Figure 1:
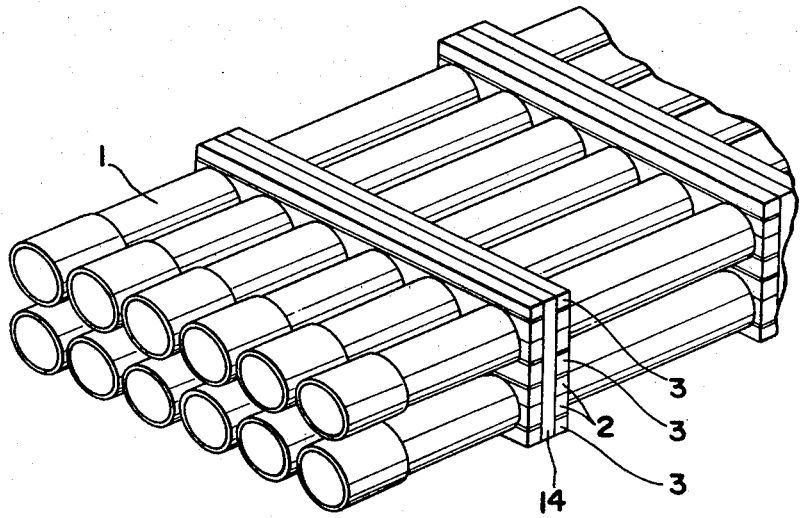
FIG. 1 is a perspective view showing the binding devices according to the invention utilized in bundling a plurality of elongated pipes.

A binding device for a plurality of elongated pipes according to this invention comprises a pair of pipe reception blocks 2 for cradling within a space formed therein a plurality of elongated pipes 1, first and second sleepers 3 interposing the pipe reception blocks 2, and a bundling strap 14 for tightly encircling a pair of pipe reception blocks 2 and the first and second sleepers 3. The bundle assembly using this binding device may be stacked in multiple on one or more of a similar bundle assembly as shown in FIG. 1. In this case the intervening sleeper between the underlying assembly and the overlying assembly is either the first sleeper of the underlying assembly or the second sleeper of the overlying assembly, and either one of them can be dispensed with. The elongated pipe to be handled with the binding device according to this invention may be of any size and length having a substantially circular cross section, such as steel pipes, poly-vinyl chloride pipes, glass tubes or the like.

Figure 2:
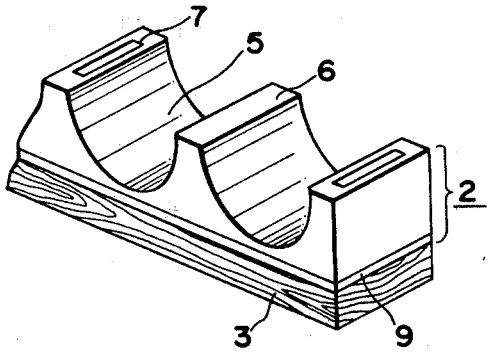
FIG. 2 is a perspective view showing a pipe reception block in overlying alignment with a sleeper.
Figure 3:
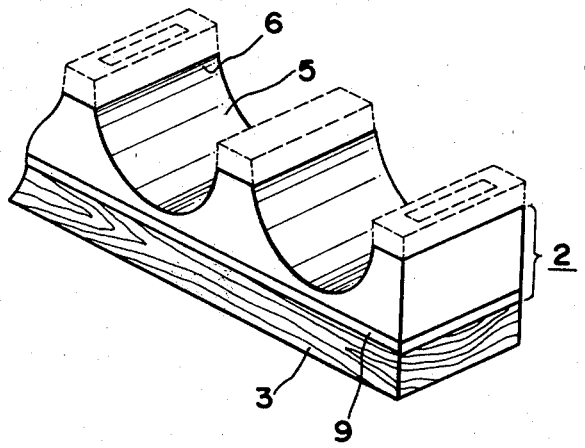
FIG. 3 is a perspective view showing a second embodiment of a pipe reception block in overlying alignment with a sleeper in which the pipe reception block is truncated.
Figure 4:
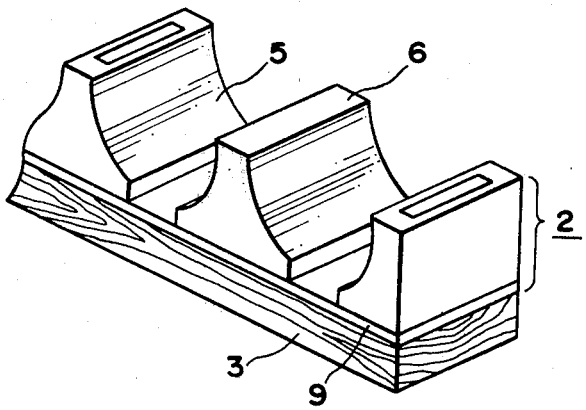
FIG. 4 is a perspective view showing a third embodiment of a pipe reception block in overlying alignment with a sleeper in which the block has concavities partially broken out.

As best shown in FIGS. 2, 3 and 4, the pipe reception block 2 is formed to be adapted to receive side by side a plurality of elongated pipes within spaces 5 which are defined by concavities formed on one surface of the pipe reception block 2. A pair of the pipe reception blocks 2 are confronted with each other in inverted arrangement thus defining the spaces 5. The radius of the concavity is substantially equal to that of the elongated pipe to be embraced within the space 5. The concavities are formed on one surface of the block 2 in equal spaced-apart relation to each other, and between the adjacent concavities there is formed a plateau section 6.

Some of the plateau sections 6 have an aperture 7 formed centrally within its body. A supporting member 8 made of such as wood block (see FIG. 5) is adapted to be inserted in this aperture 7 and capped with the like but inverted aperture of the overlying pipe reception block 2, and serves to support the weight of upper bundle assemblies when the assemblies are stacked in multiple.

Preferably, the pipe reception block 2 is composed of two regions, one is the region where the concavities are formed and the other is the region where the sleeper 3 contacts directly. The former region is made of such as rubber, plastic resin, poly-vinyl chloride resin or the like, and the most proper material may be selected from those among such materials in accordance with the kind of the pipes to be employed. In the case of steel pipes, rigid polyurethane resin has been proved to be most suitable. The latter region as designated by reference numeral 9 is preferably made of a veneer plywood. The both regions, i.e., poly-vinyl chloride resin and the veneer plywood are secured rigidly by a suitable adhesive agent. It should be noted that due to the provision of the veneer plywood between the poly-vinyl chloride resin and the sleeper 3, the height of the sleeper 3 is remarkably decreased which might have otherwise been of a considerable volume so as to withstand the external forces imparted during handling or transportation. Thus, this construction affords advantages to prevent the elongated pipes from any bending or twisting A second embodiment of the pipe reception block 2 is shown in FIG. 3 wherein the top of the plateau section 6 is truncated. This type of pipe reception block is particularly suitable when the number of bundle assemblies to be stacked is small and hence the weight imparted directly to the pipe surface is endurable. Referring now to FIG. 4, there is shown a third embodiment of the pipe reception block 2. As seen from the drawing, the polyurethane vinyl resin is broken out from the bottom of the concavity. One of the reasons why these two types of the embodiments are adopted resides in that the polyurethane vinyl resin is relatively expensive so that it is more practical to try to decrease the amount of the material.

The sleepers 3 are preferably and in this embodiment made of wood, and respectively support and rest on a pair of the pipe reception blocks 2 in contact with the surface made of the veneer plywood 9.

The bundling strap 14 may be hoops, wires, nylon strings or the like, or any other known strapping devices.

Figure 5:
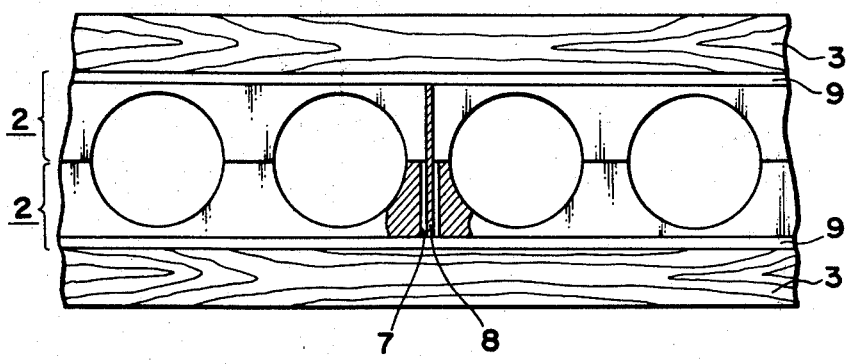
FIG. 5 is a front elevational view showing an assembly comprising of two sleepers, a pair of pipe reception blocks, and a supporting member inserted within a hole.
Figure 6:
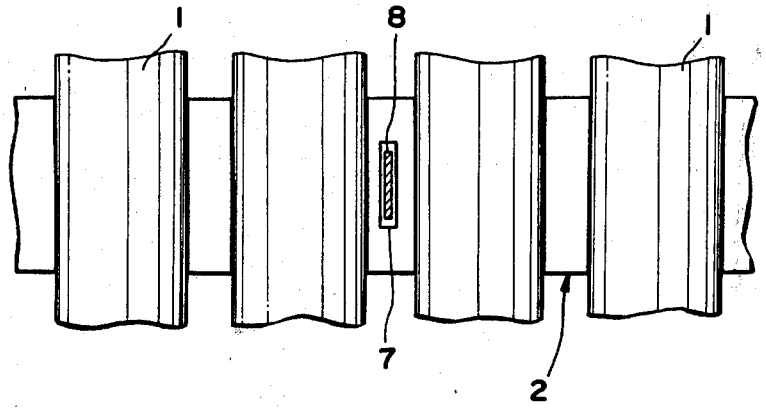
FIG. 6 is a plan view of FIG. 5.

The method of bundling or its function when used the binding device according to this invention will now be described with reference particularly to FIGS. 5 and 6.

First, a plurality of sleepers 3 are placed on the ground or shipping location in spaced-apart disposition. The pipe reception blocks 2 are then deposited on the respective sleeper and in turn a plurality of elongated pipes 1 are seated in each concavity of the blocks 2 thus arranging the elongated pipes 1 side by side in transverse relation to the sleepers 3. The supporting members 8 are inserted into the apertures 7. The supporting members 8 are not used when such conditions are met as the stacked number of the bundle assemblies is small. After inserting the supporting members 8, another pipe reception block 2 is placed in inverse arrangement with the already placed block 2 so that the elongated pipes 1 are embraced within spaces 5 defined by confronting respective concavities of two pipe reception blocks 2. Then another sleeper 3 is rest on the upper block 2 to complete one set of bundling assembly. A second bundling assembly constructed similarly as above is stacked on the first assembly, and one or more of the assemblies are stacked in multiple. These assemblies are then integrated by an encircling tightly bound strap 14. In this case, when it is necessary, each assembly may be independently tightly encircled by the strap 14. The provision of the strap 14 is effected by encircling it along the transverse surface of the binding device as shown in FIG. 1, but it is also possible to encircle any additional number of straps around the adjacent elongated pipes 1 or around the binding device in parallel direction to the longitudinal axes of the pipes 1.

The elongated pipes 1 thus embraced within the space 5 are out of contact with each other and individually supported by the concavities. Since the pipe reception blocks are made rigid enough to endure the external forces imparted thereon, the elongated pipes are free of bending or twisting during transportation and handling.

While there have been shown and described some preferred embodiments of the present invention, it is to be understood that the present invention is not limited thereto but may be variously modified and practiced within the scope set forth in the attached claims.

What is claimed is:

1. A binding device for a plurality of elongated pipes, comprising:

a pair of pipe reception blocks, each block being formed in a first region thereof with a plurality of concavities, the concavities of one block cooperating with those of the other block so that successive pairs of concavities, each pair consisting of one concavity formed in one block and a cooperating concavity formed in the other block, define a plurality of spaces for respectively receiving side by side an associated plurality of elongated pipes, adjacent ones of said spaces being equally spaced apart, each space having substantially the same curvature as that of the outer surface of the pipe associated therewith, and each block having a second region spaced apart from said first region thereof, said two regions of each block being made of different materials;

first and second sleepers which respectively support and rest on a pair of said pipe reception blocks, one of said sleepers being in contact with said second region of one of said blocks and the other of said sleepers being in contact with said second region of the other of said blocks; and bundling strap means for tightly encircling and fastening said blocks and sleepers.

2. A binding device according to claim 1, in which said first region of each block is made of rigid polyurethane resin and said second region of each block is made of a veneer plywood.

3. A binding device according to claim 2, in which said concavities substantially surround said respective pipes.

4. A binding device according to claim 2, in which said concavities only partially surround said respective pipes, excluding portions between the upper and lower surfaces of said pipes.

5. A binding device according to claim 2, in which portions respectively adjacent to the bottoms of said concavities are broken out and communicate directly with said respective second regions.

6. A binding device for a plurality of elongated pipes comprising:

a pair of pipe reception blocks for receiving side by side a plurality of elongated pipes within a space defined by two confronting concavities, said concavities being formed on respective first surfaces of said pipe reception blocks in equal spaced-apart arrangement and having substantially the same curvature as that of the outer surface of the elongated pipes;

first and second sleepers which respectively support and rest on a pair of said pipe reception blocks in contact with respective other surfaces of said pipe reception blocks; and bundling strap means for tightly encircling and fastening a pair of said pipe reception blocks interposing therebetween a plurality of elongated pipes, and said first and second sleepers;

in which between adjacent ones of said concavities a plateau section is formed and an aperture is formed centrally to the plateau section, further comprising a weight-bearing supporting member to be received in said aperture.

* * * * *